US008715100B1

(12) United States Patent
Petroske et al.

(10) Patent No.: US 8,715,100 B1
(45) Date of Patent: May 6, 2014

(54) GOLF SWING SNAKE TRAINING SYSTEM

(71) Applicants: Jeff Petroske, Forest Lake, MN (US); Paul Frannsen, Forest Lake, MN (US)

(72) Inventors: Jeff Petroske, Forest Lake, MN (US); Paul Frannsen, Forest Lake, MN (US)

( * ) Notice: Subject to any disclaimer, the term of this patent is extended or adjusted under 35 U.S.C. 154(b) by 0 days.

(21) Appl. No.: 13/760,282

(22) Filed: Feb. 6, 2013

Related U.S. Application Data

(60) Provisional application No. 61/602,182, filed on Feb. 23, 2012.

(51) Int. Cl.
*A63B 69/36* (2006.01)

(52) U.S. Cl.
USPC ..... 473/274; 473/257

(58) Field of Classification Search
USPC ..... 473/207, 208, 215, 257, 266, 272–277, 473/422, 451, 409; 482/83, 86–90
See application file for complete search history.

(56) References Cited

U.S. PATENT DOCUMENTS

| | | | | |
|---|---|---|---|---|
| 3,138,388 | A | 6/1964 | Charles et al. | |
| 3,443,811 | A * | 5/1969 | Brooks | 473/274 |
| 3,880,431 | A * | 4/1975 | Swanson | 473/139 |
| 5,125,663 | A | 6/1992 | Lurowist, Jr. | |
| 5,303,926 | A | 4/1994 | Owens et al. | |
| 5,415,407 | A * | 5/1995 | Beatty | 473/409 |
| 5,439,226 | A * | 8/1995 | Luedtke | 473/232 |
| 5,511,789 | A | 4/1996 | Nakamura | |
| 6,120,386 | A | 9/2000 | Hill | |
| 6,805,641 | B2 * | 10/2004 | Pope | 473/274 |
| 6,896,630 | B1 * | 5/2005 | Breining | 473/422 |
| 7,273,416 | B2 * | 9/2007 | Peek | 473/257 |
| 7,275,998 | B1 * | 10/2007 | Jenkins et al. | 473/274 |
| 8,016,690 | B2 | 9/2011 | Rushe | |
| 8,088,020 | B2 * | 1/2012 | Groves | 473/266 |
| 8,480,505 | B2 * | 7/2013 | Huff | 473/266 |

* cited by examiner

*Primary Examiner* — Nini Legesse

(74) *Attorney, Agent, or Firm* — RG Patent Consulting, LLC; Rachel Gilboy

(57) ABSTRACT

A device that can be used to assist a golfer in setting up their body for swinging a golf club and provides proper alignment of the head, back and knees prior to swinging the club. Through repetition of swinging a golf club, the golfer using this training system will improve muscle memory and develop a consistent swing and improvement in having the golf club strike the golf ball resulting in a lower score for a round of golf.

20 Claims, 5 Drawing Sheets

GOLF SWING SNAKE TRAINING SYSTEM

CROSS-REFERENCE TO RELATED APPLICATION

The present applications are related to and claims priority from prior provisional application Ser. Nos. 61/602,182 filed Feb. 23, 2012 which applications are incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of golf training devices and more specifically relates to a golf swing snake training system to provide a proper stance conditioning that maintains correct head, back, and knee placement during the swing of a golf club. Further, the device helps the golfer with muscle memory.

2. Description of the Related A

Golfers, whether playing as professionals or as a weekend or occasional player constantly try to improve their game and work on the mechanics of their swing in order to lower their scores. They often search for devices to help them improve their game; particularly their swing. Some golfers may hire a trainer or coach, but this can be expensive. Alternately, other golfers may use various devices in an attempt to improve their swing that may not help significantly in their progress.

Over the years many golf training devices have been provided with each of them addressing a different aspect of the game such as hitting the ball from the tee box and fairway or addressing and hitting a golf ball on the green. Many golfers take pride in their ability to hit the drives and fairway shots long and straight. Every player is aware that stance and movement of the body and its appendages must be coordinated in order to properly strike the golf ball with a selected club. The golfer's head, arms, shoulders, torso, hips and knees must move in coordination to achieve a satisfactory stroke. To accomplish this objective it is helpful to develop muscle memory so that each part of the golfer's body works together in sync during the backswing and downswing of hitting the golf ball. It is also important to be able to easily transport a device, and many of the devices available to a golfer cannot be conveniently compacted and stored directly in a golf bag for ultimate accessibility. Such a device is desired.

Various attempts have been made to solve the above-mentioned problems such as those found in U.S. Pat. No. 3,138,388 to Harold et al; U.S. Pat. No. 5,303,926 to Owens et al; and U.S. Pat. No. 5,511,789 to Nakamura; U.S. Pat. No. 5,125,663 to Lurowist, Jr.; and U.S. Pat. No. 6,120,386 to Hill; U.S. Pat. No. 8,016,690 to Rushe. This prior art is representative of golf training devices. None of the above inventions and patents, taken either singly or in combination, is seen to describe the invention as claimed.

Ideally, a golf swing snake training system should provide an easily transportable device for assuming a proper stance that maintains correct head, back, and knee placement during the swing of a golf club, and yet, would operate reliably and be manufactured at a modest expense. Thus, a need exists for a reliable golf stance training system to avoid the above-mentioned problems.

BRIEF SUMMARY OF THE INVENTION

In view of the foregoing disadvantages inherent in the known golf training device art, the present invention provides a novel golf swing snake training system. The general purpose of the present invention, which will be described subsequently in greater detail, is to provide a device that can be used to assist a golfer in setting up their stance for swinging a golf club and provides proper alignment of the head, back and knees prior to swinging the club.

A golf swing snake training system is disclosed herein, in a preferred embodiment, comprising: a golf-stance-training-assembly in combination comprising a training-stand-base, a training-stand-connector-member, a training-stand-vertical-support, and a positionable-contact-guide. The golf-stance-training-assembly is modular such that it is easy to assemble, disassemble and transport.

The training-stand-base preferably comprises at least a pair of base-feet comprising in combination a left-base-foot and a right-base foot thereby providing stability to the golf-stance-training-assembly when assembled and used. The training-stand-base comprises (round) PVC tubing in preferred embodiments. The pair of horizontal-base-feet comprises exactly one left-base-foot and one right-base-foot in preferred embodiments however may comprise more feet in alternate embodiments. The pair of base-feet are each removeably couplable into the training-stand-connector-member to form the training-stand-base. The pair of base-feet are horizontally oriented such as to provide a sturdy base when assembled spanning a suitable surface area to prevent tipping of the golf-stance-training-assembly when assembled and used. The left-base-foot and the right-base-foot are oriented substantially perpendicular to each other when assembled. The pair of base-feet are horizontally oriented and positioned such as to not impede a stance of a golfer when addressing a golf ball.

The training-stand-connector-member may also comprise PVC and the training-stand-connector-member comprises a corner bracket for a conduit frame. The training-stand-connector-member comprises in combination a body member having a first-opening, a second-opening, and a third-opening. The first-opening, second-opening, and third-opening, each allowing for insertion(s) of the feet and vertical member therein. Thus, the training-stand-connector-member is connectable to the left-base-foot and the right-base-foot as insertions. The training-stand-connector-member is connectable to the training-stand-vertical-support as an insertion (vertically).

The training-stand-vertical-support comprises in combination a vertical-support body including a vertical-first-end, and a vertical-second-end; each located on opposing terminal ends of the training-stand-vertical-support. The training-stand-vertical-support preferably comprises PVC tubing (other materials may be used for the various components, but PVC is preferred since it is lightweight, relatively inexpensive and readily available for manufacture) and is oriented vertically at 90 degrees to the training-stand-base when assembled. The training-stand-vertical-support is connected to the contact-guide-connector of the positionable-contact-guide and the training-stand-vertical-support is telescopic such that it is height adjustable to accommodate the different heights of golfers and different desired positionings.

The positionable-contact-guide comprises in combination a contact-guide-connector, a flexible-training-conduit, and a padded-body-contact-section. The flexible-training-conduit preferably comprises a sheath and a plurality of hinged joints aligned in series. The hinged joints are flexibly-rotatably-movable in relation to adjacently-positioned hinged joints such that it may be bent into a desired position and maintain that desired position until re-manipulated. The flexible-training-conduit is connected through the padded-body-contact-section.

The padded-body-contact-section comprises a foam tube inserted over and about the flexible-training-conduit with the flexible-training-conduit providing stiffening and rigidity for the foam tube; the foam providing comfort to the user when touching it. The flexible-training-conduit and padded-body-contact-section, when manipulated, are used to instill muscle memory in a golfer over an extended period. The training-stand-vertical-support is able to be adjusted such that the padded-body-contact-section is able to alternately touch-contact body parts. The body parts are selected from the group of a head, a hip, a back, and a buttock of a golfer.

The golf-stance-training-assembly may further comprise an alignment-rod, wherein the alignment-rod comprises a length of PVC tubing to provide a golfer with a visual aid to help align the feet of a golfer to assume a proper stance. The alignment-rod comprises a first-alignment-rod-end, a second-alignment-rod-end, and a body-length of about four feet to about six feet (suitable length) such that it is sufficient to provide a shot alignment indicator for the golfer.

The flexible-training-conduit is manipulatable such that the padded-body-contact-section is able to be positioned in relation to a desired body part(s) of a golfer, as mentioned, to help conform the stance of the golfer to maintain a centered position over a golf ball such that the golfer is able to realize dependable contact of the golf ball by a golf club and a more consistent swing of the golf club thereby increasing muscle memory and swing reliability over many repetitions.

The present invention holds significant improvements and serves as a golf swing snake training system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, golf swing snake training system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a golf training device and more particularly to a golf swing snake training system as used to improve the stance of a golfer when preparing to swing a golf club.

Generally speaking, golfers take pride in hitting their golf ball with a selected club to a position on the golf course that achieves their objective. Serious golfers wishing to lower their scores understand the value of developing muscle memory to enjoy the benefits of a consistent swing delivering a desired result. When starting to play a hole, the driver is normally the club selected on longer holes. Every golfer who plays on a regular basis knows how important it is to have his/her body properly aligned to strike the ball properly on a consistent basis. The proper stance includes having the head in a certain position and restricting the movement of the arms, shoulders, torso, hips and knees during the backswing and the downswing to strike the ball. If the body is not properly aligned, the golf ball may not cover the desired distance or may go the left or the right of where the golfer prefers his/her ball to go.

Most of the human errors, leading to a poorly hit ball, occur during the backswing and downswing. Many players, even after having developed a smooth, rhythmical swing, have a tendency to draw the club inwardly as the club head approaches the ball. Other players tend to chop at the ball. Other irregularities occur in the downswing of even the most experienced of players. Regardless of the age, weight and strength of the player, these, as well as other improper body movements, result in inaccurate shots with the attendant increase in score. The cure to this problem is to develop muscle memory to throughout the golfer's body so they can repeatedly swing their golf club in a manner to provide maximum results. The present invention serves o address these problems.

Figure 1:
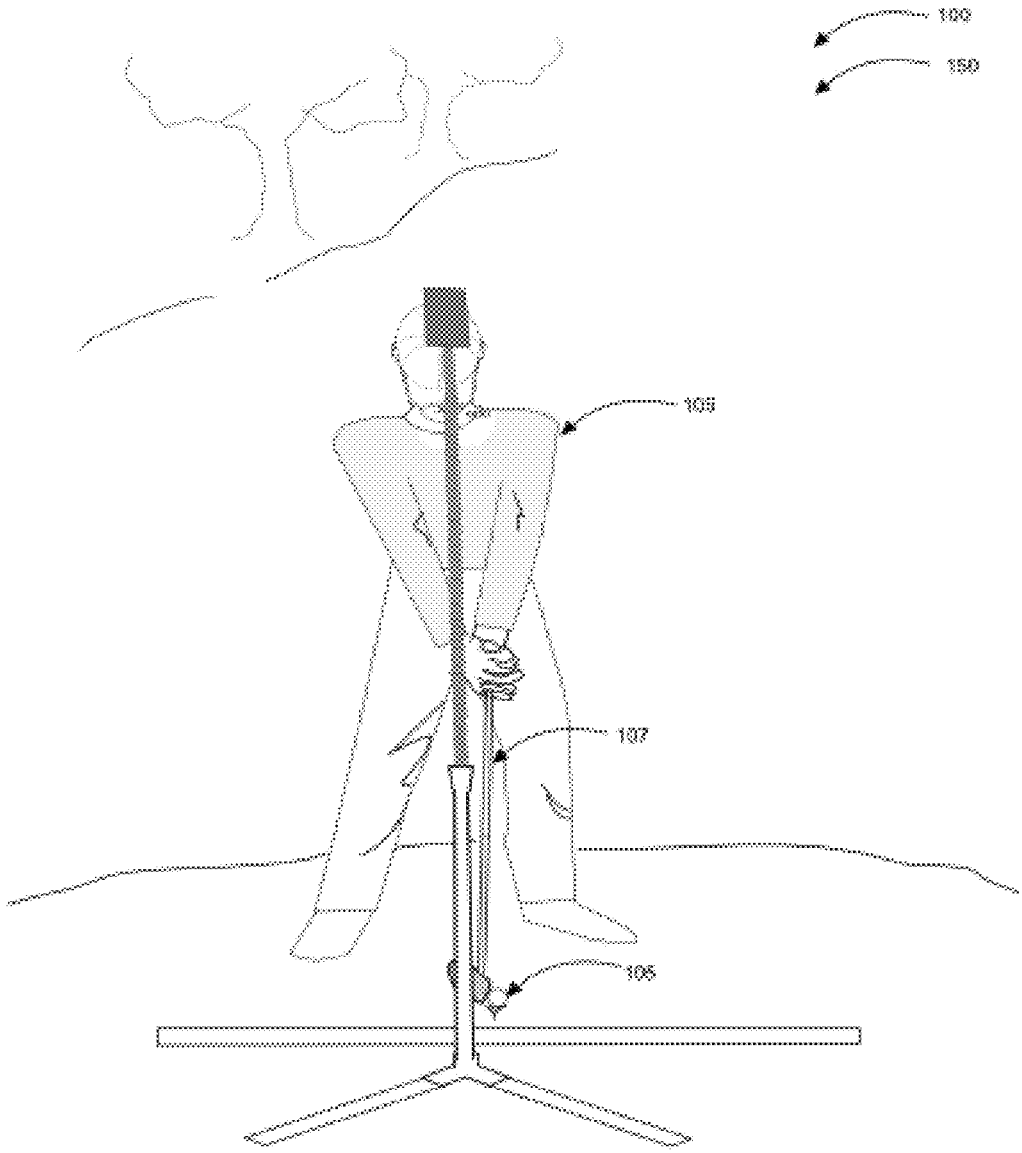
FIG. 1 shows a perspective view illustrating a golf-stance-training-system in an in-use condition as golfer addresses a golf ball according to an embodiment of the present invention.

Referring to the drawings by numerals of reference there is shown in FIG. 1, a perspective view illustrating golf-stance-training-system 100 (Golf Swing Snake System) in an in-use condition 150 as golfer 105 addresses golf ball 106 according to an embodiment of the present invention.

Golf-stance-training-system 100 preferably comprises golf-stance-training-assembly 110 comprising training-stand-base 114 including at least pair of base-feet 115 having (at least) left-base-foot 116 and right-base-foot 117. Golf-stance-training-assembly 110 further comprises training-stand-connector-member 120 comprising body member 122 having first-opening 123 second-opening 124 and third-opening 125. Golf-stance-training-assembly 110 further comprises training-stand-vertical-support 130 comprising vertical-support-body 135 having vertical-first-end 136 and vertical-second-end 137. Golf-stance-training-assembly 110 further comprises positionable-contact-guide 140 having contact-guide-connector 141, flexible-training-conduit 142, and padded-body-contact-section 143.

Figure 2:
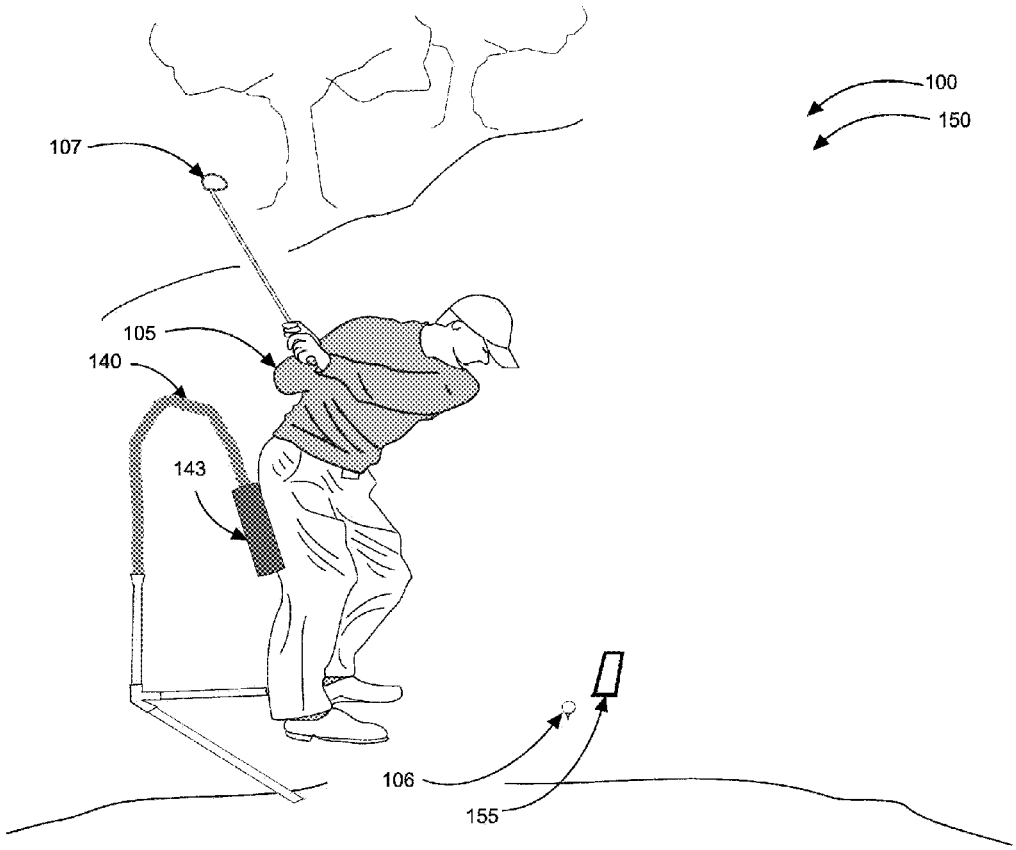
FIG. 2 is a perspective view illustrating a golf-stance-training-assembly during a backswing of a golfer according to an embodiment of the present invention of FIG. 1.

Referring now to FIG. 2, a perspective view illustrating golf-stance-training-assembly 110 in an in-use condition 150 during the backswing of golfer 105 according to an embodiment of the present invention of FIG. 1.

Flexible-training-conduit 142 of positionable-contact-guide 140 of golf-stance-training-assembly 110 is manipulatable such that padded-body-contact-section 143 of positionable-contact-guide 140 is able to be positioned in relation to a (desired) body part of golfer 105 to help conform stance of golfer 105 to maintain a centered position over golf ball 106 such that golfer 106 is able to realize dependable contact of golf ball 106 by golf club 107 and a more consistent swing of golf club 107 thereby increasing reliability over many repetitions. By taking slow practice swings using positional-contact-guide 140 in contact with body parts such as head, against the spine, between shoulder blades of golfer 105, for example, muscles of golfer 105 become accustomed to repeated movement to install muscle memory. When body part of golfer 105 moves during the backswing of golfer 105, golf-stance-training-assembly 110 no longer remains in contact with the user's body thereby letting golfer 105 realize that positional-contact-guide 140 of golf-stance-training-assembly 110 has moved and has released from body part of golfer 105.

Figure 3:
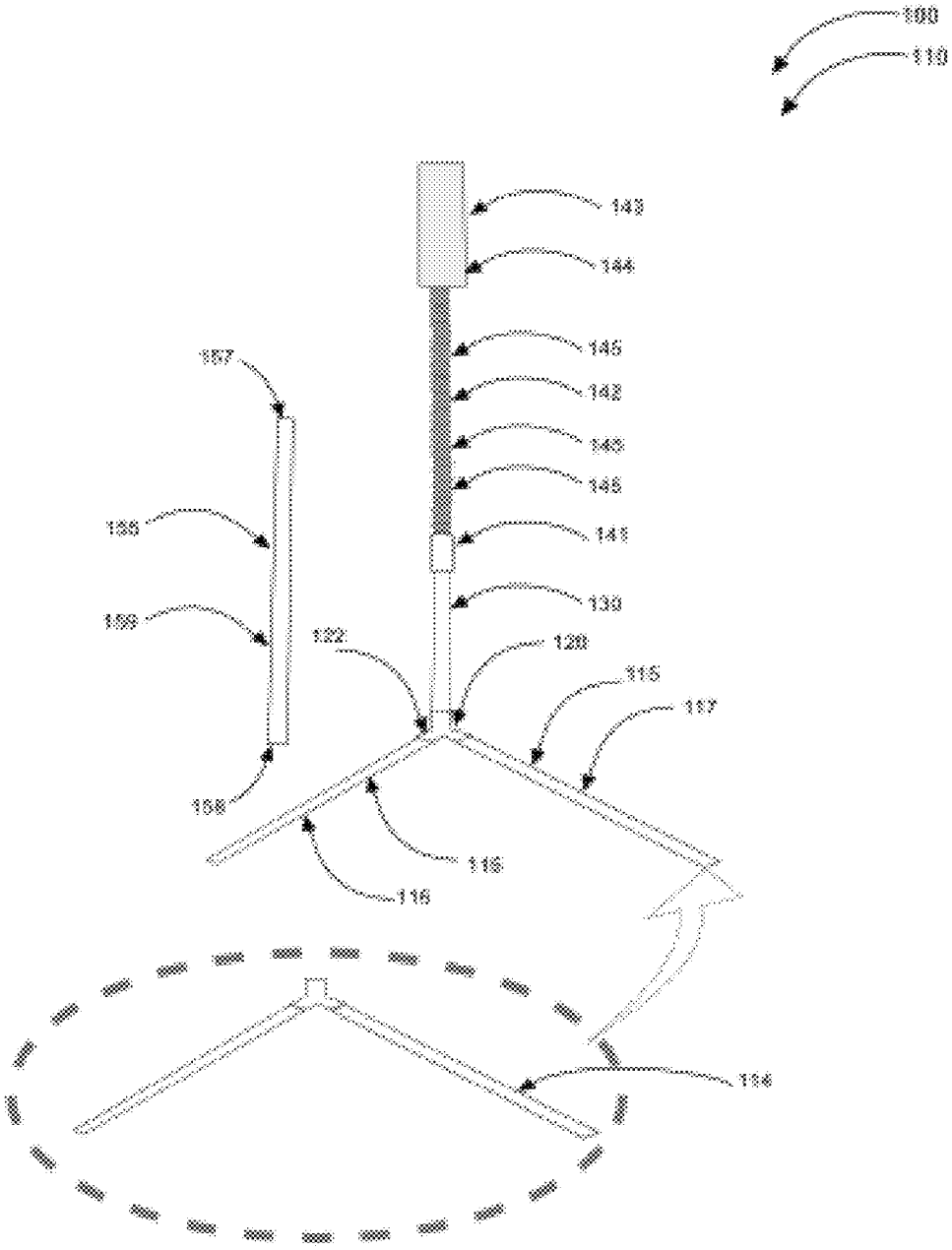
FIG. 3 is a perspective view illustrating the golf-stance-training-assembly in an assembled condition according to an embodiment of the present invention of FIG. 1.

Referring now to FIG. 3, a perspective view illustrating golf-stance-training-assembly 110 in an assembled condition according to an embodiment of the present invention of FIG. 1.

Golf-stance-training-assembly 110 comprises in combination training-stand-base 114, training-stand-connector-member 120, training-stand-vertical-support 130, and positionable-contact-guide 140. Training-stand-base 114 comprises PVC tubing and comprises at least pair of base-feet 115 comprising in combination left-base-foot 116 and right-base foot 117; this providing stability to golf-stance-training-assembly 110 when assembled for use on a golf course practice and warm-up area or other location where golfer 105 may choose to work on a golf swing.

Training-stand-connector-member 120 comprises in combination body member 122 having first-opening 123, second-opening 124, and third-opening 125. First-opening 123, second-opening 124, and third-opening 125 for insertions into training-stand-connector-member 120. Training-stand-connector-member 120 comprises PVC forming a corner bracket for a conduit frame. Pair of base-feet 115 provide a horizontal base when inserted into training-stand-connector-member 120 and are each removeably couplable into training-stand-connector-member 120 to form training-stand-base 114. Training-stand-connector-member 120 is connectable to left-base-foot 116 and right-base-foot 116. Pair of horizontal-base-feet 115 comprises exactly one left-base-foot 116 and one right-base-foot 117 in preferred embodiments. Left-base-foot 116 and right-base-foot 117 are oriented perpendicular to each other when assembled. Pair of base-feet 115 are substantially horizontally oriented such as to provide a sturdy base when assembled, spanning a surface area to prevent tipping of golf-stance-training-assembly 110 when used. Pair of base-feet 115 are horizontally oriented such as to not impede a stance of golfer 105 when addressing golf ball 106. Training-stand-connector-member 120 is connectable to training-stand-vertical-support 130 to provide height needed to utilize postionable-contact-guide 140 on a body part(s) of golfer 105.

Training-stand-vertical-support 130 comprises in combination vertical-support body 135 including vertical-first-end 136, and vertical-second-end 137. Vertical-first-end 136 and vertical-second-end 137 are located on opposing terminal ends of training-stand-vertical-support 130, as shown. Training-stand-vertical-support 130 is oriented vertically at 90 degrees to training-stand-base 114 (and ground surface) when assembled. Training-stand-vertical-support 130 is adjustable such that padded-body-contact-section 143 is able to touch-contact one of several body parts (one at a time) such as a head, hip, back, or buttock of golfer 105. Training-stand-vertical-support 130 comprises PVC tubing and is preferably telescopic.

Positionable-contact-guide 140 comprises in combination contact-guide-connector 141, flexible-training-conduit 142, and padded-body-contact-section 143. Training-stand-vertical-support 130 is connected to contact-guide-connector 141. Flexible-training-conduit 142 is connected to padded-body-contact-section 143.

Flexible-training-conduit 142 comprises a sheath and is manipulatable such that padded-body-contact-section 143 is able to be positioned in relation to a body part of golfer 105 to help conform stance of golfer to maintain a centered position over golf ball 106 such that golfer 105 is able to realize dependable contact of golf ball 106 by golf club 107 and a more consistent swing of golf club 107 thereby increasing reliability over many repetitions. This feature helps consistently improve the golf game of golfer 105 over a duration.

Figure 4:
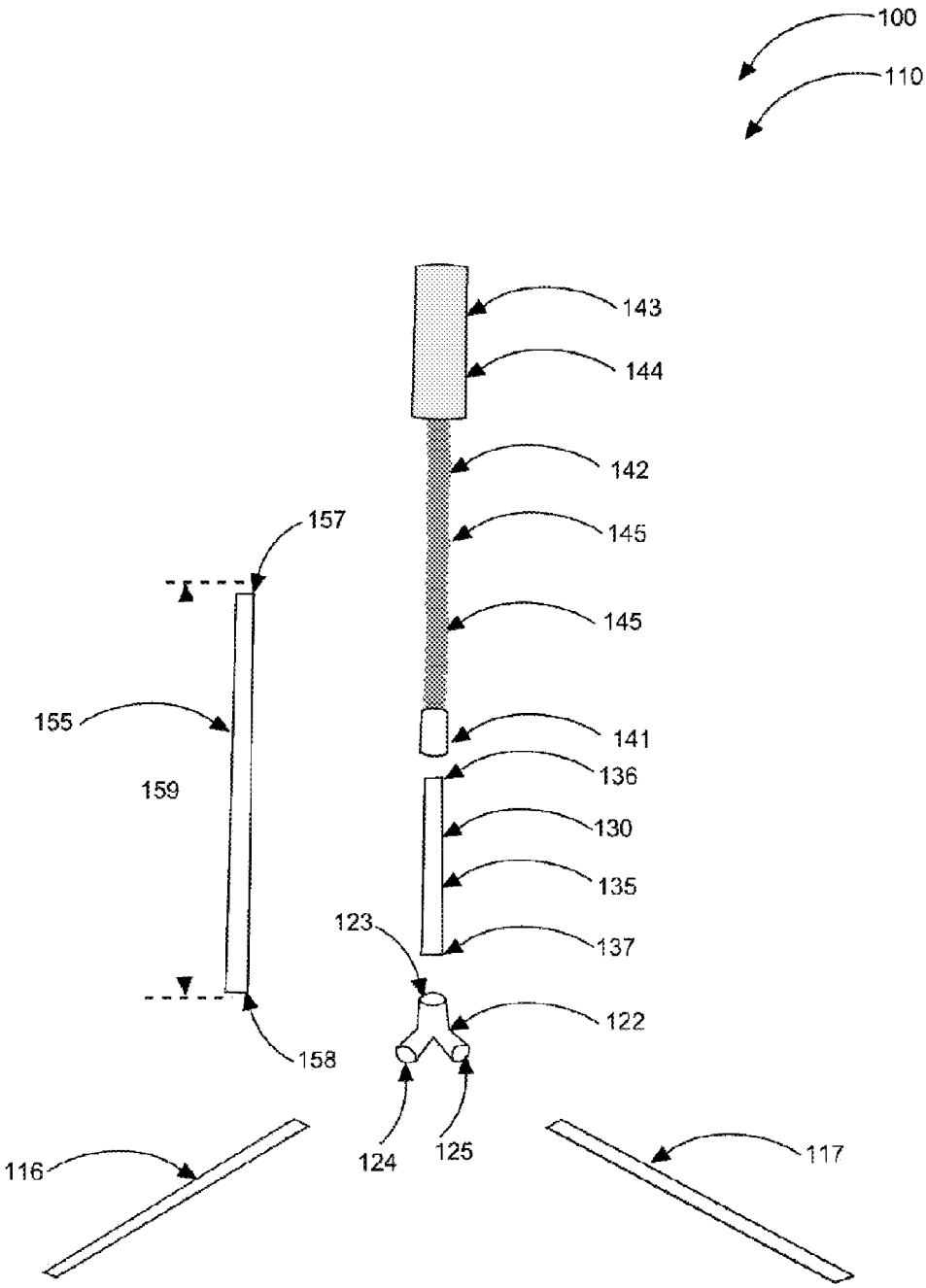
FIG. 4 is a perspective view illustrating the golf-stance-training-assembly in an unassembled condition according to an embodiment of the present invention of FIG. 1.

Referring now to FIG. 4, a perspective view illustrating golf-stance-training-assembly 110 in an unassembled condition according to an embodiment of the present invention of FIG. 1.

Golf-stance-training-system 100 comprises golf-stance-training-assembly 110 which is modular and includes left-base-foot 116, right-base-foot 117, training-stand-connector-member 120, vertical-support-body 135, and positionable-contact-guide 140 comprising contact-guide-connector 141, flexible-training-conduit 142, and padded-body-contact-section 143. Training-stand-vertical-support 130 is connected to contact-guide-connector 141 during use. Flexible-training-conduit 142 is connected to padded-body-contact-section 143 during use.

Flexible-training-conduit 142 comprises a plurality of hinged joints 145 aligned in series and are movable in relation to adjacently-positioned hinged joints 145. Flexible-training-conduit 142 and padded-body-contact-section 143, when manipulated, are used to instill muscle memory in golfer 105. Padded-body-contact-section 143 comprises foam tube 144 inserted over and about flexible-training-conduit 142 with flexible-training-conduit 142 providing stiffening and rigidity for foam tube 144.

Golf-stance-training-system 100 may further comprise alignment-rod 155 (which also may be telescopic such that it is able to fit in a gold bag) having a length of PVC tubing to provide golfer 105 with a visual aid to help align feet of golfer 105 to assume a proper stance. Alignment-rod 155 comprises first-alignment-rod-end 157, second-alignment-rod-end 158, and body-length 159 of about four feet to about six feet such that it is sufficient to provide a shot alignment indicator for golfer 105.

Figure 5:
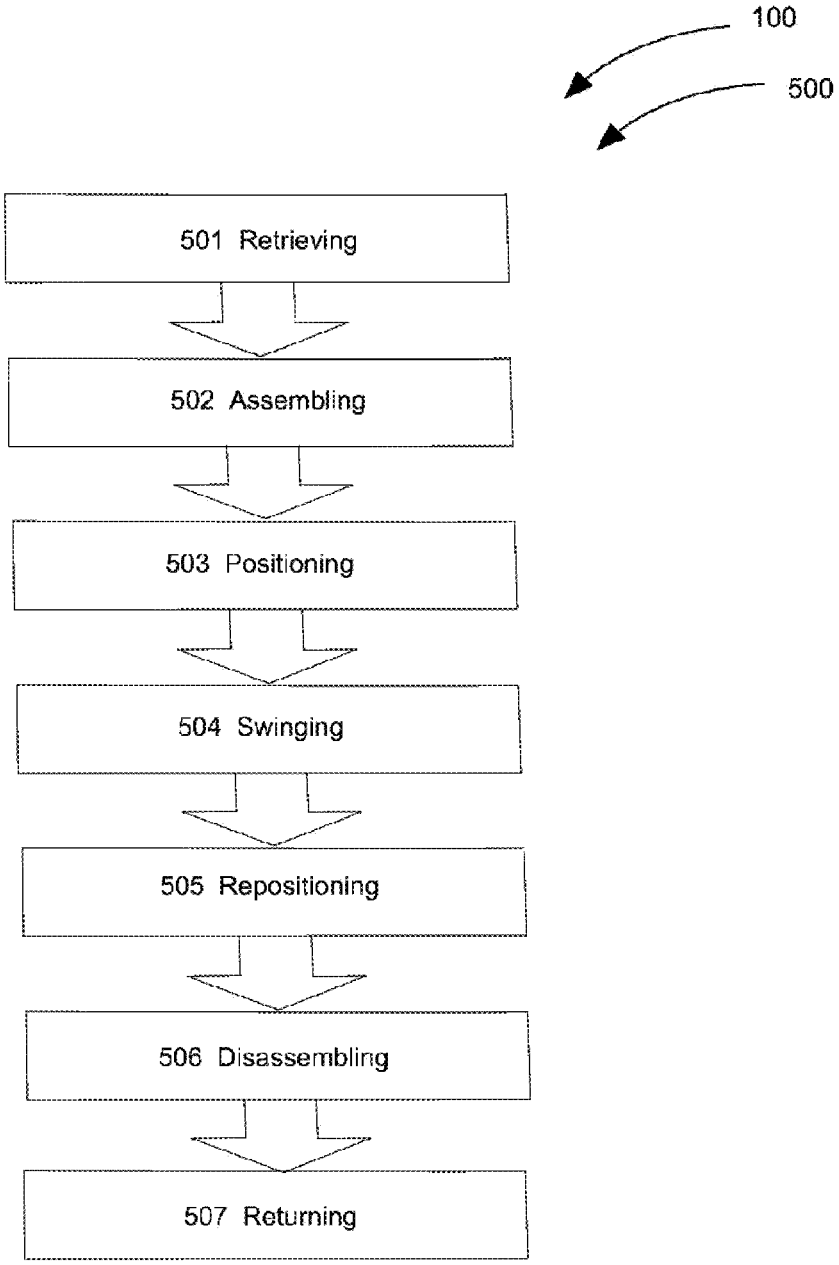
FIG. 5 is a flowchart illustrating a method of use of the golf stance training system according to an embodiment of the present invention of FIGS. 1-4.

Referring now to FIG. 5, a flowchart illustrating a method of use 500 of golf-stance-training-system 100 according to an embodiment of the present invention of FIGS. 1-4.

A method of use 500 for golf-stance-training-system 100 preferably comprises the steps of: step one 501 retrieving golf-stance-training-assembly 110 from a stored position in a golf bag; step two 502 assembling components of golf-stance-training-assembly 110; step three 503 positioning padded-body-contact-section 143 to part of body being trained; step four 504, swinging golf club repeatedly to improve muscle memory; step five 505 repositioning padded-body-contact-section 143 to another part of body being trained as often as desired, step six 506 disassembling golf-stance-training-assembly 110; and step seven 507 returning golf-stance-training-assembly 110 to a stored position in a golf bag.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A golf swing snake training system comprising:

a) a golf-stance-training-assembly comprising;
  i) a training-stand-base including;
    (1) at least a pair of base-feet comprising;
      (a) a left-base-foot; and
      (b) a right-base-foot;
  ii) a training-stand-connector-member comprising;
    (1) a body member including;
      (a) a first-opening;
      (b) a second-opening; and
      (c) a third-opening;
  iii) a training-stand-vertical-support comprising;
    (1) a vertical-support body having;
      (a) a vertical-first-end; and
      (b) a vertical-second-end;
  iv) a positionable-contact-guide comprising;
    (1) a contact-guide-connector;
    (2) a flexible-training-conduit; and
    (3) a padded-body-contact-section; and
    (4) alignment rod;

b) wherein said golf-stance-training-assembly comprises in combination said training-stand-base, said training-stand-connector-member, said training-stand-vertical-support, and said positionable-contact-guide;

c) wherein said training-stand-base comprises said at least a pair of base-feet comprising in combination said left-base-foot and said right-base foot structured and arranged for providing stability to said golf-stance-training-assembly when used;

d) wherein said training-stand-connector-member comprises in combination said body member having said first-opening, said second-opening, and said third-opening, said first-opening, said second-opening, and said third-opening structured and arranged for insertions therein;

e) wherein said training-stand-vertical-support comprises in combination said vertical-support body including said vertical-first-end, and said vertical-second-end, said vertical-first-end and said vertical-second-end located on opposing terminal ends;

f) wherein said training-stand-vertical-support is structured and arranged for adjusting such that a padded-body-contact-section is able to alternately touch-contact body parts selected from group of a head, a hip, a back, and a buttock of a golfer;

g) wherein said positionable-contact-guide comprises in combination said contact-guide-connector, said flexible-training-conduit, and said padded-body-contact-section;

h) wherein said golf-stance-training-assembly is modular;

i) wherein said at least a pair of horizontal-base-feet are each structured and arranged for removeably coupling into said training-stand-connector-member to form said training-stand-base;

j) wherein said pair of base-feet are horizontally oriented such as structured and arranged to provide a sturdy base when assembled spanning a surface area to prevent tipping of said golf-stance-training-assembly when used;

k) wherein said pair of base-feet are structured and arranged such as to not impede a stance of a golfer when addressing a golf ball;

l) wherein said training-stand-connector-member is structured and arranged for connecting to said left-basefoot and said right-base-foot;

m) wherein said training-stand-connector-member is structured and arranged for connecting to said training-stand-vertical-support;

n) wherein said training-stand-vertical-support is structured and arranged for connecting to said contact-guide-connector;

o) wherein said flexible-training-conduit is structured and arranged for connecting to said padded-body-contact-section; and p) wherein said flexible-training-conduit is structured and arranged for manipulating such that said padded-body-contact-section is able to be positioned in relation to a body part of said golfer to conform said stance of said golfer to maintain a centered position over said golf ball such that said golfer is able to realize dependable contact of said golf ball by a golf club and a more consistent swing of said golf club thereby increasing reliability over many repetitions q) wherein said alignment-rod comprises a length of tubing structured and arranged to provide said golfer with a visual aid for aligning feet of said golfer to assume a proper said stance;

r) wherein said length of said alignment-rod is structured and arranged as a shot alignment indicator for said golfer;

s) whereby said golf-stance-training-assembly is structured and arranged to comprise said golf swing snake training system.

2. The golf swing snake training system of claim 1 wherein said alignment-rod comprises a length of PVC tubing to provide said golfer with a visual aid to help align feet of said golfer to assume a proper said stance.

3. The golf swing snake training system of claim 2 wherein said alignment-rod comprises said first-alignment-rod-end, said second-alignment-rod-end, and a body-length of about four feet to about six feet such that it is sufficient to provide a shot alignment indicator for said golfer.

4. The golf swing snake training system of claim 1 wherein said training-stand-base and said training-stand-vertical-support comprise PVC tubing.

5. The golf swing snake training system of claim 4 wherein said at least a least a pair of horizontal-base-feet comprises exactly one of said left-base-foot and one of said rightbase-foot.

6. The golf swing snake training system of claim 4 wherein said training-stand-connector-member comprises PVC, said training-stand-connector-member comprising a corner bracket for a conduit frame.

7. The golf swing snake training system of claim 4 wherein said flexible-training-conduit comprises a sheath.

8. The golf swing snake training system of claim 4 wherein said flexible-training-conduit comprises a plurality of hinged joints aligned in series, said hinged joints movable in relation to adjacently-positioned said hinged joints.

9. The golf swing snake training system of claim 4 wherein said left-base-foot and said right-base-foot are oriented perpendicular to each other when assembled.

10. The golf swing snake training system of claim 1 wherein said training-stand-vertical-support is oriented vertically at 90 degrees to said training-stand-base when assembled.

11. The golf swing snake training system of claim 1 wherein said training-stand-vertical-support is adjustable.

12. The golf swing snake training system of claim 11 wherein said training-stand-vertical-support is telescopic.

13. The golf swing snake training system of claim 11 wherein said flexible-training-conduit and said padded-body-contact-section when manipulated are used to instill muscle memory in said golfer.

14. The golf swing snake training system of claim 13 wherein said training-stand-vertical-support is able to be adjusted such that said padded-body-contact-section is able to touch-contact said body part, said body part comprising a head of said golfer.

15. The golf swing snake training system of claim 13 wherein said training-stand-vertical-support is able to be adjusted such that said padded-body-contact-section is able to touch-contact said body part, said body part comprising a back of said golfer.

16. The golf swing snake training system of claim 13 wherein said training-stand-vertical-support is able to be adjusted such that said padded-body-contact-section is able to touch-contact said body part, said body part comprising a buttock of said golfer.

17. The golf swing snake training system of claim 7 wherein said padded-body-contact-section comprises a foam tube inserted over and about said flexible-training-conduit, said flexible-training-conduit providing stiffening and rigidity for said foam tube.

18. A golf swing snake training system comprising:

a) a golf-stance-training-assembly comprising;
  i) a training-stand-base including;
    (1) a pair of base-feet comprising;
      (a) a left-base-foot; and
      (b) a right-base-foot;
b) a training-stand-connector-member comprising;
  i) a body member including;
    (1) a first-opening;
    (2) a second-opening; and
    (3) a third-opening;
c) a training-stand-vertical-support comprising;
  i) a vertical-support body having;
    (1) a vertical-first-end; and
    (2) a vertical-second-end;
d) a positionable-contact-guide comprising;
  i) a contact-guide-connector;
  ii) a flexible-training-conduit; and
  iii) a padded-body-contact-section; and
e) an alignment-rod;
f) wherein said golf-stance-training-assembly is modular;
g) wherein said golf-stance-training-assembly comprises in combination said training-stand-base, said training-stand-connector-member, said training-stand-vertical-support, and said positionable-contact-guide;
h) wherein said training-stand-base comprises said at least a pair of base-feet comprising in combination said left-base-foot and said right-base foot providing stability to said golf-stance-training-assembly when used;
i) wherein said at least a least a pair of horizontal-base-feet comprises exactly one of said left-base-foot and one of said right-base-foot;
j) wherein said at least a pair of horizontal-base-feet are each removeably couplable into said training-stand-connector-member to form said training-stand-base;
k) wherein said pair of base-feet are horizontally oriented such as to provide a sturdy base when assembled spanning a surface area to prevent tipping of said golf-stance-training-assembly when used;
l) wherein said left-base-foot and said right-base-foot are oriented perpendicular to each other when assembled;
m) wherein said pair of base-feet are horizontally oriented such as to not impede a stance of a golfer when addressing a golf ball;
n) wherein said training-stand-connector-member comprises PVC, said training-stand-connector-member comprising a corner bracket for a conduit frame;
o) wherein said training-stand-connector-member comprises in combination said body member having said first-opening, said second-opening, and said third-opening,
p) said first-opening, said second-opening, and said third-opening, each allowing for insertion(s) therein;
q) wherein said training-stand-connector-member is connectable to said left-basefoot and said right-base-foot as said insertions;
r) wherein said training-stand-connector-member is connectable to said training-stand-vertical-support as a said insertion;
s) wherein said training-stand-vertical-support comprises in combination said vertical-support body including said vertical-first-end, and said vertical-second-end, said vertical-first-end and said vertical-second-end located on opposing terminal ends;
t) wherein said training-stand-base and said training-stand-vertical-support comprise PVC tubing;
u) wherein said training-stand-vertical-support is oriented vertically at 90 degrees to said training-stand-base when assembled;
v) wherein said training-stand-vertical-support comprises long and short said PVC tubing such that it is height adjustable;
w) wherein said positionable-contact-guide comprises in combination said contact-guide-connector, said flexible-training-conduit, and said padded-body-contact-section;

x) wherein said training-stand-vertical-support is connected to said contact-guide-connector;

y) wherein said flexible-training-conduit comprises a sheath;

z) wherein said flexible-training-conduit comprises a plurality of hinged joints aligned in series, said hinged joints flexibly-rotatably-movable in relation to adjacently-positioned said hinged joints;

aa) wherein said flexible-training-conduit is connected through said padded-body-contact-section;

bb) wherein said padded-body-contact-section comprises a foam tube inserted over and about said flexible-training-conduit, said flexible-training-conduit providing stiffening and rigidity for said foam tube;

cc) wherein said flexible-training-conduit and said padded-body-contact-section when manipulated are used to instill muscle memory in said golfer over an extended period;

dd) wherein said training-stand-vertical-support is able to be adjusted such that said padded-body-contact-section is able to alternately touch-contact body parts, said body parts selected from the group of a head, a hip, a back, a buttock of said golfer;

ee) wherein said golf-stance-training-assembly further comprises said alignment-rod;

ff) wherein said alignment-rod comprises a length of PVC tubing to provide said golfer with a visual aid to help align feet of said golfer to assume a proper said stance;

gg) wherein said alignment-rod comprises said first-alignment-rod-end, said second-alignment-rod-end, and a body-length of about six feet such that it is sufficient to provide a shot alignment indicator for said golfer; and hh) wherein said flexible-training-conduit is manipulatable such that said padded-body-contact-section is able to be positioned in relation to desired said body ii) part(s) of said golfer to help conform said stance of said golfer to maintain a centered position over said golf ball such that said golfer is able to realize dependable contact of said golf ball by a golf club and a more consistent swing of said golf club thereby increasing reliability over many repetitions jj) wherein said training-stand-vertical-support is structured and arranged for adjusting such that a padded-body-contact-section is able to alternately touch-contact body parts selected from group of a head, a hip, a back, and a buttock of a golfer;

kk) wherein said alignment-rod comprises a length of tubing structured and arranged to provide said golfer with a visual aid for aligning feet of said golfer to assume a proper said stance;

ll) wherein said length of said alignment-rod is structured and arranged a shot alignment indicator for said golfer;

mm) whereby said golf-stance-training-assembly is structured and arranged to comprise said golf swing snake training system.

19. The golf swing snake training system of claim 18 further comprising a kit including:

a) said left-base-foot;

b) said right-base-foot;

c) said training-stand-connector-member;

d) said training-stand-vertical-support;

e) said positionable-contact-guide; and f) a carrying bag;

g) wherein said kit is storable within a golf club bag.

20. A method of use for a golf swing snake training system of claim 18 comprising the steps of:

a) retrieving a golf-stance-training-assembly from a stored position in a golf bag;

b) assembling components of golf-stance-training-assembly;

c) positioning padded-body-contact-section to part of body being trained;

d) swinging a golf club repeatedly to improve muscle memory;

e) repositioning said padded-body-contact-section to another part of said body being trained as often as desired, f) disassembling golf-stance-training-assembly; and g) returning said golf-stance-training-assembly to a stored position in a said golf bag.

* * * * *